US006173669B1

(12) United States Patent
Staerzl

(10) Patent No.: US 6,173,669 B1
(45) Date of Patent: Jan. 16, 2001

(54) APPARATUS AND METHOD FOR INHIBITING FOULING OF AN UNDERWATER SURFACE

(75) Inventor: Richard E. Staerzl, Fond du Lac, WI (US)

(73) Assignee: Brunswick Corporation, Lake Forest, IL (US)

( * ) Notice: Under 35 U.S.C. 154(b), the term of this patent shall be extended for 0 days.

(21) Appl. No.: 09/418,122

(22) Filed: Oct. 14, 1999

(51) Int. Cl.[7] ..... B63B 59/00

(52) U.S. Cl. ..... 114/222; 204/196.05; 204/196.06; 204/196.37; 205/740

(58) Field of Search ..... 114/222; 204/196.02, 204/196.03, 196.05, 196.06, 196.37; 205/740, 725–729

(56) References Cited

U.S. PATENT DOCUMENTS

| | | | | |
|---|---|---|---|---|
| 948,355 | * | 2/1910 | Delius et al. | 114/222 |
| 994,405 | * | 6/1911 | James | 114/222 |
| 1,021,734 | * | 3/1912 | Tatro et al. | 114/222 |
| 3,069,336 | | 12/1962 | Waite et al. | 204/148 |
| 3,241,512 | | 3/1966 | Green | 114/222 |
| 3,497,434 | | 2/1970 | Littauer | 204/147 |
| 3,625,852 | | 12/1971 | Anderson | 204/196 |
| 3,661,742 | | 5/1972 | Osborn et al. | 204/147 |
| 3,766,032 | | 10/1973 | Yeiser | 204/147 |
| 4,012,503 | | 3/1977 | Freiman | 424/145 |
| 4,046,094 | | 9/1977 | Preiser et al. | 114/222 |
| 4,058,075 | | 11/1977 | Piper, Sr. | 114/222 |
| 4,092,943 | | 6/1978 | Lund et al. | 114/222 |
| 4,170,185 | | 10/1979 | Murphy et al. | 114/222 |
| 4,214,909 | | 7/1980 | Mawatari et al. | 106/16 |
| 4,283,461 | | 8/1981 | Wooden et al. | 428/422 |
| 4,322,633 | | 3/1982 | Staerzl | 307/95 |
| 4,559,017 | | 12/1985 | Cavil et al. | 440/76 |
| 4,869,016 | | 9/1989 | Diprose et al. | 43/124 |
| 4,943,954 | | 7/1990 | Ostlie | 367/191 |
| 4,971,663 | * | 11/1990 | Sadoway et al. | 204/56.1 |
| 5,052,962 | | 10/1991 | Clark | 440/83 |
| 5,088,432 | | 2/1992 | Usami et al. | 114/67 |
| 5,143,011 | | 9/1992 | Rabbette | 114/222 |
| 5,298,794 | | 3/1994 | Kuragaki | 307/95 |
| 5,318,814 | | 6/1994 | Elliott et al. | 428/36 |
| 5,342,228 | | 8/1994 | Magee et al. | 440/76 |
| 5,386,397 | | 1/1995 | Urroz | 367/139 |
| 5,465,676 | | 11/1995 | Falcaro | 114/222 |
| 5,532,980 | | 7/1996 | Zarate et al. | 367/139 |
| 5,552,656 | | 9/1996 | Taylor | 310/337 |
| 5,629,045 | | 5/1997 | Veech | 427/297 |
| 5,716,248 | | 2/1998 | Nakamura | 440/76 |
| 5,735,226 | | 4/1998 | McNeal | 114/222 |
| 5,820,737 | | 10/1998 | Kohn | 204/196 |
| 5,889,209 | | 3/1999 | Piedrahita et al. | 73/570 |
| 5,964,992 | * | 10/1999 | Swette et al. | 204/196.06 |

OTHER PUBLICATIONS

"Chemistry and Industry", Section 5, p. 123, published Mar. 5, 1990.

Baltimore Business Journal, vol. 10, No. 47, Section 1, p. 3.

* cited by examiner

*Primary Examiner*—Sherman Basinger
(74) *Attorney, Agent, or Firm*—William D. Lanyi

(57) ABSTRACT

A marine fouling prevention system comprises two conductive surfaces and a device that alternates the direction of electric current between the two surfaces. The current is caused to flow through sea water in which the two surfaces are submerged or partially submerged. A monitor measures the current flowing from one of the two conduction surfaces and compares it to the current flowing into the other conduction surface to assure that no leakage of current of substantial quantity exists. The system applies a low magnitude current density, of approximately 0.10 to 0.50 milliamperes per square foot, for an extended duration of time of approximately 10 to 20 minutes. By alternating current direction between the two surfaces, both surfaces can be provided with sufficient chlorine gas bubbles to prevent marine growth from attaching to the surfaces.

17 Claims, 10 Drawing Sheets

APPARATUS AND METHOD FOR INHIBITING FOULING OF AN UNDERWATER SURFACE

BACKGROUND OF THE INVENTION

1. Field of the Invention

The present invention is generally related to an anti-fouling apparatus for marine components and, more particularly, to a device that creates an electric current in the region directly proximate an underwater surface in order to inhibit the growth of marine life on an underwater surface such as a boat hull.

2. Description of the Prior Art

For over a thousand years, it has been known that a ship's hull is subject to fouling by marine growth. Copper cladding had been used successfully for many years until the introduction of vessels with iron hulls which prevented its use because of the potential for galvanic action. By 1850, various paints containing copper salts had been developed. Over the past few centuries, the pace of the development of anti-fouling techniques has been influenced by warfare, and several naval encounters have been decided by the greater speed of a naval vessel that resulted because of superior anti-fouling technology.

Currently, copper salts are used in the majority of anti-fouling paints, although the most effective modem anti-foulings contain tributyltin (TBT) as well as copper salts. Recent restrictions on the use of TBT and anti-fouling paints has led to renewed interest in developing novel, environmentally acceptable anti-fouling techniques.

Throughout the description of the present invention, the unwanted growth on a ship's hull or other underwater surface will be referred to as fouling. Although fouling is primarily a biological phenomenon, its implications relate to engineering. Due to an increase in the resistance to movement of the hull through water, fouling of the hulls of ships results in a reduction in speed, an increase in the cost of fuel, and losses in both time and money in the application of remedial measures.

Underwater surfaces rapidly absorb organic material, referred to as conditioning films, which may influence the subsequent settlement of microorganisms. Bacteria and diatoms are soon present after immersion in water, resulting in a slime that covers the submerged surface. Following the establishment of the micro fouling slime layer, macro fouling rapidly develops. The macro fouling community is often described as either soft fouling or hard fouling. Soft fouling comprises algae and invertebrates such as soft corals, sponges, anemones, tunicates, and hydroids while hard fouling comprises invertebrates such as barnacles, mussels, and tubeworms.

Mariners from ancient times were aware of the problems resulting from both boring and fouling organisms. Various treatments were employed, and some of these techniques have been retried many times in many forms over more than 2,000 years. The ancient Phoenicians and Carthaginians addressed this problem over 400 years BC. The Greeks and Romans both independently used lead sheathing which the Romans secured by copper nails. In the early 16th century, Spain officially adopted lead sheathing and its use soon spread to France and England. Although it actually offered little in the way of protection against fouling, lead was the material most frequently used prior to the eighteenth century. However, its corrosive effect on iron ships was soon noticed and the British Admiralty abandoned the use of lead in 1682 for that reason.

Other treatments to prevent worms from penetrating the planking relied on a wooden sheath placed over a layer of animal hair and tar. The wooden sheathing was sometimes filled with iron or cooper nails that had large heads. This, in effect, created an outer metallic cladding. Paints were also used that had mixtures of tar, brimstone and grease. The first successful anti-fouling device was copper sheathing and the first documented evidence for the use of copper as an anti-fouling method dates back to 1625. Copper was used in 1758 on the hull of the HMS Alarm, and by 1780 copper was in general use by the British Navy. Sir Humphry Davy showed that it was actually the dissolution of the copper in sea water that prevented fouling.

In the nineteenth century, with the growing importance of iron ship building, the use of copper sheathing on the boats was discontinued. As a result, the weight of fouling quickly made the ships unmaneuverable and unseaworthy. Various alternatives were tried including sheathings of zinc, lead, nickel, galvanized iron and alloys of antimony, zinc and tin, followed by wooden sheathing which was then layered with copper.

By 1960, metallic soap was applied hot and contained copper sulfate. From these early attempts at coatings, anti-fouling paints incorporating cuprous oxide, mercuric oxide, or arsenic in shellac varnish or a resin matrix with turpentine, naphtha or benzene as solvents developed. From these formulations, modern anti-fouling paints were developed. Anti-fouling paints are currently in wide use on yachts and pleasure crafts as well as deep sea vehicles. The presence of tributyltin (TBT) in estuaries and in the sea is thought to result from the increased use of tributyltin-containing paints on these types of vessels.

Another technique for inhibiting fouling is to reduce the ease with which bacteria and algae adhere to the surfaces. The main type of low energy non-biocidal coatings are fluoro-polymers and silicones. Fluoropolymers have been under development in the United States during the past several decades. They are based on fluoro-polyurethane paints, either pigmented with PTFE or containing silicone for fluoro-epoxy additives. Although the surfaces do accumulate fouling organisms, their attachment is weak. Coatings developed to date require twice yearly cleaning with bristled brushes to remove fouling growth and can therefore only be useful as coatings on small boats.

Various other non-toxic techniques have been attempted. Both ultrasonic (e.g. 14 kHz) and low frequency (e.g. 30 Hz) sound waves inhibit barnacle settlement and may have application to fouling control in certain circumstances. These and many other anti-fouling techniques are described in an article written by Maureen Callow in the publication titled "Chemistry and Industry" at Section 5, pg. 123, on Mar. 5, 1990.

As described in the Baltimore Business Journal, Vol. 10, No. 47, Section 1, pg. 3 on Apr. 23, 1993, McCormick & Company has discovered that its red pepper extracts are natural repellents of barnacles and zebra mussels. A coating of this type has been tested, and it has been determined that it repels both barnacles and zebra mussels which have become costly nuisances in the Great Lake Region by clogging intake pipes for power plants and water treatment plants. It is estimated that several billion dollars in damage will be caused by zebra mussels before the turn of the century.

U.S. Pat. No. 5,532,980, which issued to Zarate, et al on Jul. 2, 1996, discloses a vibrational anti-fouling system. The system produces vibrations in an underwater structure for the purpose of inhibiting the attachment of aquatic life forms to the structure. The system includes a controller which drives one or more transducers. The transducer comprises a housing, one end of which is closed by a resilient diaphragm. An electromagnet with soft magnetic core is contained in the housing spaced from the unsupported portion of the diaphragm. The unsupported portion of the diaphragm is mounted over an underwater structure. In operation, the electromagnet is excited with a current pulse, which deforms the diaphragm so that the housing moves towards the structure. As the current drops off, the diaphragm is restored to its original shape and the housing moves away from the structure imparting a vibrational force to the structure. The transducer includes an elastic membrane to compensate the changes in temperature and pressure commonly found when working underwater. The magnetic cores positioned in the transducers are saturated by current pulses generated by the controller to eliminate the effects of component variations and allow multiple units to be connected to the controller without changes in sound levels. The system is highly resistant to electrolytic corrosion since, most of the time, there is no voltage difference between the resonators, wires and ground.

U.S. Pat. No. 5,386,397, which issued to Urroz on Jan. 31, 1995, describes a method and apparatus for keeping a body surface, which is in contact with water, free of fouling. A sound wave is generated for keeping a surface free of scale, fouling and dirt by the adherence of organisms such as marine life, the surface being part of the body that is in contact with water. The method comprising of steps of generating and emitting from at least one location of the body, at least one high frequency sound wave train forming, adjacent to the body surface, a vibrating field encircling the body surface. The molecular energy of the water within the field is increased to generate a drastic drop in the density of the water as well as the density of the cells of the organisms entering the vibrating field. This alters the habitat of the organisms and discourages the organisms from adhering to the body surface.

U.S. Pat. No. 4,058,075, which issued to Piper on Nov. 15, 1977, discloses a marine life growth inhibitor device. The device is used for inhibiting marine life on the outer surface of submerged object such as boat. The device includes a controller connected to a source of electrical power and a plurality of speakers electrically connected to the controller and attached at predetermined locations on the interior of the boat's hull, whereby vibrations may be transmitted through the hull. The controller may also include a transformer for reducing the voltage of the alternating current power source. Each of the plurality of speakers has a speaker diaphragm having first and second speaker diaphragm sides. Each of the speakers is mounted in a speaker housing secured to the hull of the boat for enabling transfer of acoustical energy from both the first and second side of the speaker diagram to the boat hull to inhibit the growth of marine life on the exterior surface of the boat hull. The speakers are selected to produce acoustical vibration in the audible range.

U.S. Pat. No. 5,143,011, which issued to Rabbette on Sep. 1, 1992, discloses a method and apparatus for inhibiting barnacle growth on boats. The system for inhibiting growth of barnacles and other marine life on the hull of a boat includes a plurality of transducers or vibrators mounted on the hull and alternately energized at a frequency of 25 Hertz through a power source preferably the boat battery, and a control system. The system has two selectable operating modes. One is continuous and the other is periodic. Also, when the voltage of the battery falls below a predetermined level, transducers are automatically de-energized to allow charging of the battery after which the transducers are energized.

U.S. Pat. No. 5,629,045, which issued to Veech on May 13, 1997, describes a biodegradable nosiogenic agents for control of non-vertebrae pests. Fouling of marine structures, such as boats, by shell bearing sea animals which attach themselves to such structures, such as barnacles, is generally inhibited by coatings containing lipid soluble, non-toxic, biodegradable substances which prevent the animals from sitting down on the structures. These substances attack the nervous system of the barnacle, neutralize the glue extruded by the barnacle, and otherwise prevent the barnacles from attaching themselves to surfaces immersed in the aqueous marine environment while being benign to the environment. A preferred inhibitor is pepper containing capsaicin. The inhibitor is incorporated into standard marine paints, impregnates, varnishes and the like.

U.S. Pat. No. 5,318,814, which issued to Elliott et al on Jun. 7, 1994, describes the inhibiting of the settling of barnacles. Settlement of barnacles on surfaces in a marine environment is inhibited by employing as a construction material for said surfaces of polymers including methyl methacrylate and an effective amount (preferably about 2% to about 10%) of a copolymerizable N-substituted maleimide.

U.S. Pat. No. 3,241,512, which issued to Green on Mar. 22, 1966, describes an anti-fouling, barnacles, algae, eliminator. The apparatus is intended for boats and, in particular, comprises a pair of copper bus bars or electrodes, or a pair of perforated tubes, or both the electrodes and perforated tubes positioned on opposite sides of the keel of a boat whereby copper ions, chlorine gas or bubbles, or combination of the ions and chlorine gas produced bubbles that float upward from the keel on both sides thereof following the contour lines of the boat hull cleaning the surface thereof and removing barnacles, algae, and other foreign and undesirable matter.

U.S. Pat. No. 3,625,852, which issued to Anderson on Dec. 7, 1971, describes a marine anti-fouling system. The system is intended for use with boat and ship hulls having a keel and sides diverging upwardly therefrom. The anti-fouling system comprises a pair of laterally spaced elongated anode electrode components each mounted externally on one side of the hull substantially adjacent the keel and lengthwise thereof. It also comprises an elongated cathode electrode component mounted externally on and lengthwise of the keel in spaced relationship between the anode electrode components. The system further comprises a source of electrical current and electrical circuit means therefor for energizing the anode electrode components with a positive potential and the cathode electrode components with a negative potential with the cathode electrode component being electrolytically common to the anode electrode components.

United States patent 4,012,503, which issued to Freiman on Mar. 15, 1977, discloses a coating composition used to control barnacles. Toxicant compositions containing the combination of tri-n-butyltin fluoride with zinc oxide and specified substituted triazines effectively inhibit the development of marine organisms, including barnacles and algae, that are responsible for fouling. These compositions are particularly useful as the active component in antifouling coatings.

U.S. Pat. No. 4,214,909, which issued to Mawatari et al on Jul. 29, 1980, describes an aquatic antifouling method.

The method for controlling fouling to structures caused by aquatic fouling organisms such as barnacles, slime, sea moss, algae, etc. which comprises applying to the structures sesquiterpene alcohols such as farnesol, nerolidol, and dehydronerolidol, and the organic carboxylic acid esters thereof.

U.S. Pat. No. 5,465,676, which issued to Falcaro on Nov. 14, 1995, discloses a barnacle shield. A system for discouraging and inhibiting marine growth onto a boat's underwater hull surface comprises a plurality of sections of foam filled PVC pipe tied together to form a flotation frame, an envelope of flexible, polyethylene, bubble wrap material, of a size and shape to enclose the underwater part of a boat's hull, and affixed to and supported by the flotation frame, a sprinkler hose affixed to the flotation frame for injecting fresh water for washing the boat's underwater hull, and a plurality of drain/check valves mounted in the envelope for eliminating the wash down water in the envelope.

U.S. Pat. No. 4,170,185, which issued to Murphy et al on Oct. 9, 1979, describes a means for preventing marine fouling. The effective antifouling result with respect to marine creatures such as barnacles is achieved by energizing a piezofilm layer carried on the outside of a vessel to cause mechanical vibration of the layer.

U.S. Pat. No. 4,046,094, which issued to Preiser et al on Sep. 6, 1977, discloses an antifouling system for active ships which are at rest. A system for discouraging and inhibiting growth of the entire marine fouling community onto a ship hull while it is at rest in brackish or seawater is described. A pipe or pipes having nozzles distributed therealong, run the length of the keel. Fresh water is supplied to the pipe which flows out the nozzles and up along the hull to create and maintain a moving boundary layer of fresh water. Such movement also serves to inhibit fouling. An enclosure comprising segmented, over-lapping opaque curtains hang down by weights, from the ship-deck. These curtains serve to prevent light from reaching the hull, and to protect the thin boundary layer of fresh water from the disruptive, mixing actions caused by the surrounding currents. Thus the marine fouling community, including tubeworms, barnacles, grass, and algae, may be inhibited from growing and adhering to the hull surface.

U.S. Pat. No. 4,283,461, which issued to Wooden et al on Aug. 11, 1981, describes a piezoelectric polymer antifouling coating. An antifouling coating for marine structures in the form of a film containing piezoelectric polymer material, which, when electrically activated vibrates at a selected frequency to present a surface interfacing with water which is inhospitable for attachment of vegetable and animal life including free-swimming organisms thereby discouraging their attachment and their subsequent growth thereon to the macrofoulant adult stage is disclosed.

U.S. Pat. No. 5,342,228, which issued to Magee et al on Aug. 30, 1994, discloses a marine drive which is provided with a large volume anode, about 30 cubic inches, for galvanic protection. The anode is a brick-like block member tapered along each of its height, width, and length dimensions. The drive housing has a anode mounting section extending rearwardly therefrom and has a downwardly opening cavity of substantially the same shape and volume as the anode, and receiving the anode in nested flush relation.

U.S. Pat. No. 5,716,248, which issued to Nakamura on Feb. 10, 1998, discloses a sacrificial anode for a marine propulsion unit. The sacrificial anode arrangements for a marine propulsion unit is disclosed wherein the sacrificial anode is juxtaposed to the trim tab and is detachably connected to the lower unit housing by fastening means which can be removed from the upper surface thereof. In one embodiment, the trim tab is detachably connected to the sacrificial anode and is connected to the outer housing portion through the sacrificial anode.

U.S. Pat. No. 5,298,794, which issued to Kuragaki on Mar. 29, 1994, describes an electrical anticorrosion device for a marine propulsion apparatus. The device primarily relates to an electrical anticorrosion apparatus for a marine propulsion arrangement. More particularly, the device relates to an anodic protection arrangement which is suitable for use with an inboard/outboard propulsion unit. According to the description in this patent, an anode and the reference electrode are housed within a housing unit which is mounted upon a propulsion unit mounting bracket. The two electrodes are arranged so that each is essentially equidistant from a point located approximate midway across the lateral width of an outboard drive unit, which unit is secured to the mounting bracket, when the unit is positioned for driving the associated watercraft in a generally forward direction.

U.S. Pat. No. 4,322,633, which issued to Staerzl on Mar. 30, 1982, discloses a marine cathodic protection system. The system maintains a submerged portion of the marine drive unit at a selected potential to reduce or eliminate corrosion thereto. An anode is energized to maintain the drive unit at a pre-selected constant potential in response to the sensed potential at a closely located reference electrode during operation. Excessive current to the anode is sensed to provide a maximum current limitation. An integrated circuit employs a highly regulated voltage source to establish precise control of the anode energization.

U.S. Pat. No. 5,052,962, which issued to Clark on Oct. 1, 1991, describes a naval electrochemical corrosion reducing. The corrosion reducer is used with ships having a hull, a propeller mounted on a propeller shaft and extending through the hull, therein supporting the shaft, at least one thrust bearing and one seal. Improvement includes a current collector and a current reduction assembly for reducing the voltage between the hull and shaft in order to reduce corrosion due to electrolytic action. The current reduction assembly includes an electrical contact, the current collector, and the hull. The current reduction assembly further includes a device for sensing and measuring the voltage between the hull and the shaft and a device for applying a reverse voltage between the hull and the shaft so that the resulting voltage differential is from 0 to 0.05 volts. The current reduction assembly further includes a differential amplifier having a voltage differential between the hull and the shaft. The current reduction assembly further includes an amplifier and the power output circuit receiving signals from the differential amplifier and being supplied by at least one current supply. The current selector includes a brush assembly in contact with a slip ring over the shaft so that its potential may be applied to the differential amplifier.

U.S. Pat. No. 4,559,017, which issued to Cavil et al on Dec. 17, 1985, discloses a constant voltage anode system. The marine propulsion unit has a housing exposed to sea water and subject to attack by the sea water. It has a permanent type anode housing with a substantially constant surface characteristic which is mounted on the housing and supplied with constant voltage. Holes under the anode through the housing which extend to interior passages permits the current of the anode to influence and protect the passages.

U.S. Pat. No. 3,497,434, which issued to Littauer on Feb. 24, 1970, discloses a method for preventing fouling of metal in a marine environment. It anodically dissolves metals that are toxic to marine organisms. This is done under controlled conditions to prevent fouling by marine organisms of structures immersed in a marine environment.

U.S. Pat. No. 5,889,209, which issued to Piedrahita et al on Mar. 30, 1999, describes a method and apparatus for preventing biofouling of aquatic sensors. A submersible ultrasonic emitter is integrated with a dissolved oxygen or other aquatic probe so that biofouling of the sensors' membrane is minimized. Sonification, that is, exposure to ultrasound, precludes the needs to use other biofouling elimination procedures such as water/air jets, chemical treatments, or biocides. The invention can be configured to readily integrate with existing probes from a variety of manufacturers, and eliminates membrane cleaning as the maintenance interval constraint for field or laboratory deployed sensors.

U.S. Pat. No. 5,735,226, which issued to McNeal on Apr. 7, 1998, describes a marine anti-fouling system and method. The system and method is disclosed for inhibiting the growth of marine life on a submerged surface and includes a control box and a number of transducers. The control box further includes an ultrasonic driver board, a magna-polar filter, and a power source. The ultrasonic driver board generates an electrical signal having an ultrasonic frequency which continually varies between 25 KHz and 60 KHz. A portion of this continually varying electrical signal is passed through the magna-polar filter where the signal is enhanced. This enhanced signal is then returned to the ultrasonic driver board where is combined with the electrical signal varying between 25KHz and 60 KHz. This combined signal is then electrically communicated to a number of transducers which are mounted on the submerged surface to be protected. There, the electrical signal having combined frequencies is translated from electrical energy to acoustic energy which is transmitted to the submerged surface to inhibit the growth of marine life on the submerged surface.

U.S. Pat. No. 5,552,656, which issued to Taylor on Sep. 3, 1996, describes a self-powered anti-fouling device for watercraft. The device comprises a layer of piezoelectric material, preferably a poled plastic material such as a PVDF polymer, for mounting on the hull of a watercraft. The layer has electrodes on opposite major surfaces thereof, and the layers are connected to a power supply comprising a battery and a d.c to a.c. converter. The converter generates an a.c. voltage at a frequency, such as 20 KHz, for causing vibrations of the layer, such vibrations serving to retard the growth of water dwelling organisms in the craft. The layer electrodes are also connected to an a.c. to d.c. converter for converting a.c. energy to d.c. energy suitable for trickle charging the power supply battery. Accordingly, during transit of the craft through the water, water induced hull vibrations cause vibrations of the layer for generating a.c. energy for storage in the battery, which stored energy is used for causing anti-fouling vibrations of the energy generating layer.

U.S. Pat. No. 4,943,954, which issued to Ostlie on Jul. 24, 1990, describes a method and system for counteracting marine biologic fouling of a hull or submerged construction. A system and a method for counteracting marine fouling of a vessel hull are provided. Electro-mechanical vibration transducers are arranged in pairs adjacent to fixed nodal lines on the hull and are driven in an inverted phase relationship in order to provide a water particle movement in a hull parallel direction right outside side nodal lines in addition to the hull perpendicular relative movements right outside the transducers. The invention also comprises a combination of the mechanical system above and a special surface coating which counteracts fouling from other organisms than those influenced by the water particle movement in the infrafrequency range.

U.S. Pat. No. 4,058,075, which issued to Piper on Nov. 15, 1977, describes a marine life growth inhibitor device. The device is used for inhibiting marine life on the outer surface of a submerged object such as a boat. The device includes a controller connected to a source of electrical power and a plurality of speakers electrically connected to the controller and attached at predetermined locations on the interior on the boat's hull, whereby vibrations maybe transmitted through the hull. The controller may also include a transformer for reducing the voltage of the alternating current power source. Each of the plurality of speakers has a speaker diaphragm having a first and a second speaker diaphragm side. Each of the speakers is mounted in a speaker housing secured to the hull of the boat for enabling transfer of acoustical energy from both the first and second side of the speaker diaphragm to the boat hull to inhibit the growth of marine life on the exterior surface of the boat hull. The speakers are selected to produce acoustical vibration in the audible range.

U.S. Pat. No. 4,092,943, which issued Lund et al on Jun. 6, 1978, describes a marine protection system. An underwater marine protection system for preventing or retarding marine growth on vessels, pilings, in submerged structures in which a boat slip, or the like, has a series of gas diffusers placed under the water located to direct gas towards the bottom of the marine vessel is described. The gas diffusers are connected to an ozone source for direction ozone gas through the diffusers towards the bottom of a boat. Skirts or curtains are connected to the pilings in the boat slip to prevent the free flow of water into and out of the slip where the water has been treated. A special top extends across the slip and around the vessel therein to increase the effectiveness of the ozone. An alternate embodiment has the gas diffusers formed in the bottom of the boat or submarine structure.

U.S. Pat. No. 4,170,185, which issued to Murphy et al on Oct. 9, 1979, discloses a system for preventing marine fouling. The effective antifouling result with respect to marine creatures such as barnacles is achieved by energizing a piezofilm layer carried on the outside of a vessel to cause mechanical vibrations of the layer.

U.S. Pat. No. 3,069,336, which issued to Waite et al on Dec. 18, 1962, discloses a means for protecting ships' hulls. The system relates to ships and in particular to the protection of metal hulls against corrosion, but it further relates to the protection of ships' hulls against fouling with barnacles or other similar marine growth and marine vegetation.

U.S. Pat. No. 3,766,032, which issued to Yelser on Oct. 16, 1973, discloses a method for controlling marine fouling. An electrical apparatus and method is disclosed for eliminating the fouling of boat bottoms and the like by marine growth. The underwater surface is sheathed with strips of metal such as stainless steel. An electric current is passed between the adjacent strips or areas, preferably for short periods of time on a regular maintenance schedule (e.g. 30 amperes per square foot for a few seconds every two days). The sheathing may be of 0.020" stainless steel in 3-inch wide strips spaced 0.100 inches apart. Test panels in sea water are found to remain clean and bright after six months immersion when so energized, while identical panels to which no current is applied become heavily fouled. Ions produced by electrolysis close to the sheathed surface move at relatively high velocities, and are found to kill the small organisms that settle on the surface. No persistent toxic chemicals such as mercury compounds are released into the water, and only minute quantities of dead organic matter are released at any time.

U.S. Pat. No. 3,661,742, which issued to Osborn et al on May 9, 1972, describes an electrolytic method of marine fouling control. The improved method of inhibiting the sustained attachment of marine organisms to metallic surfaces while preventing corrosion of the metallic surfaces by cathodic protection is disclosed. Inhibition of marine organisms attachment takes place when toxic ions are forced into solution by reversing and increasing the current density in the cathodic protection system at periodic intervals for short periods of time.

U.S. Pat. No. 1,021,734, which issued to Delius et al on Mar. 26, 1912, describes a process for protecting ships from barnacles. The invention relates to sea going vessels which have hulls which are either made of metal or sheathed with metal and is intended for protection of vessels from the accumulation of barnacles. This is accomplished by providing a means for electrically destroying the barnacles that may be attached to the ship.

U.S. Pat. No. 4,869,016, which issued to Diprose et al on Sep. 26, 1989, describes a marine biofouling reduction invention. The method provides a substantial reduction of marine corrosion in sea water by micro and macro biofouling. An alternating current is generated of sufficient strength and frequency sufficient to shock marine biofouling organisms and sufficient to upset the normal behavior patterns of the marine biofouling organisms and trained in the sea water passing around or through the structure. The device causes release into the water around or within the structure controlled amounts of chlorine ions and copper ions to produce an environment actively hostile to potential marine biofouling organisms.

U.S. Pat. No. 5,088,432, which issued to Usami et al on Feb. 18, 1992, describes a system for providing anti-fouling for substances in contact with sea water. It comprises a first conductive membrane that is coated on the outer side of the electric insulator mounted at the surface of the substance such as ships and composes thin sheets of metal having low specific resistance or metal oxide, spray-coated membrane, evaporated membrane, or fused membrane. The second conductive anti-fouling membrane has a higher electric resistance than the first conductive membrane.

U.S. Pat. No. 5,820,737, which issued to Kohn on Oct. 13, 1998, describes an anti-fouling laminate marine structure. The structure is submersible in sea water, such as a boat hull, and is electrically activated. The hull is formed of inner and outer skins. The outer skin forms an exposed surface and is coated with a metallic paint defining a cathode electrode. The core is constituted by balsa wood or foam plastic modules. This is attached to an open mesh material that includes conductive fibers to create an electrical grid defining anodic electrode that is embedded in the laminate.

The patents described above are hereby explicitly incorporated by reference in the following description.

United States application Ser. No. 09/188,967 (M09308), which was filed on Nov. 9, 1998, by Staerzl and assigned to the assignee of the present invention discloses an apparatus and method for inhibiting fouling of an underwater surface. The system for inhibiting marine organism growth on underwater surfaces provides an electric current generator which causes an electric current to flow proximate the underwater surface. A power source, such as a battery, provides electrical power to the electric current generator. The flow of current passes from the underwater surface through the water surrounding the surface or in contact with the surface and a point of ground potential. The point of ground potential can be a marine propulsion system attached to a boat on which the underwater surface is contained.

Over the previous thousand years that mankind has ventured across the seas in ships, many attempts have been made to avoid the disastrous effects of marine fouling on the hulls of those ships. These attempts have included various types of cladding, treating, and painting. In addition, electromechanical schemes have been used to vibrate the hulls for the purpose of discouraging the attachment of various types of micro-organisms. Fresh water has been used to discourage the growth of barnacles and other marine life.

As described above, fouling of underwater surfaces has been recognized as a problem for many years. Anti-fouling techniques, such as biocidal paints, can contribute to the pollution of waterways. Many other methods simply are not effective. It would therefore be significantly beneficial if a device or method could be developed which does not pollute the environment, but effectively inhibits the growth of marine organisms on surfaces which are submerged in water such as boat hulls, pipes, pilings, and grates.

It would be significantly beneficial if a system or device could be provided which inhibits the growth of marine organisms, but does not cause degradation of any components that are intended to be protected by the anti-fouling system. In addition, it would be significantly beneficial if an anti-fouling system could be provided which does not have any negative effect on a marine propulsion system or boat and does not degrade itself in any way during this operation. Furthermore, it would be significantly beneficial if a marine fouling prevention system could be provided that efficiently uses electrical power to inhibit fouling of marine surfaces in order to minimize the necessity to frequently recharge batteries or rely on shore power for these purposes.

SUMMARY OF THE INVENTION

A marine fouling prevention system made in accordance with the present invention comprises first and second conductive surfaces that are each disposed at least partially below the surface of the body of water during operation of the fouling prevention system. In addition, the system comprises an electric current generating device connected in electrical communication with both the first conductive surface and the second conductive surface to cause an electric current to flow between the first and second conductive surfaces. Furthermore, it comprises a control circuit connected in electrical communication with the first and second conductive surfaces in order to periodically change the direction of the electrical current between the first and second conductive surfaces. It also comprises a timer for causing the control circuit to change the direction of current after a preselected period of time in one of two possible directions.

The first and second conductive surfaces can be first and second portions of the boat hull or, can be first and second portions of the surface of a stern drive housing unit. The first and second surfaces can comprise an inert metallic conductor or a graphite material which is embedded within a nonconductive matrix. Alternatively, the first and second surfaces can comprise a metallic oxide material.

In a particularly preferred embodiment of the present invention, the current flowing between the first and second conductive surfaces has a current density which is less than 50 milliamperes per square foot and the predetermined period of time during which the current flows in either of the two preferred directions is approximately 20 minutes.

A fault protection circuit is also provided which compares the current flowing from one of the first and second conductive services with the current flowing into the other one of the first and second conductive surfaces. An alarm circuit detects an alarm condition when the current flowing from one of the surfaces is not equal to the current flowing into the other surface within an acceptable differential magnitude.

The method performed by the present invention comprises the steps of providing first and second conductive surfaces which are at least partially below the surface of the body of water during operation of the system. It also comprises the steps of causing an electric current to flow between the two surfaces and periodically changing the direction of the electrical current between the first and second surfaces. It also comprises the steps of causing the control circuit to change the direction of current after a preselected period of time and comparing the current flowing from one of the surfaces to the current flowing into the other surface. It also provides the step of detecting an alarm condition when the current flowing from one of the surfaces does not generally equal the current flowing into the other surface.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
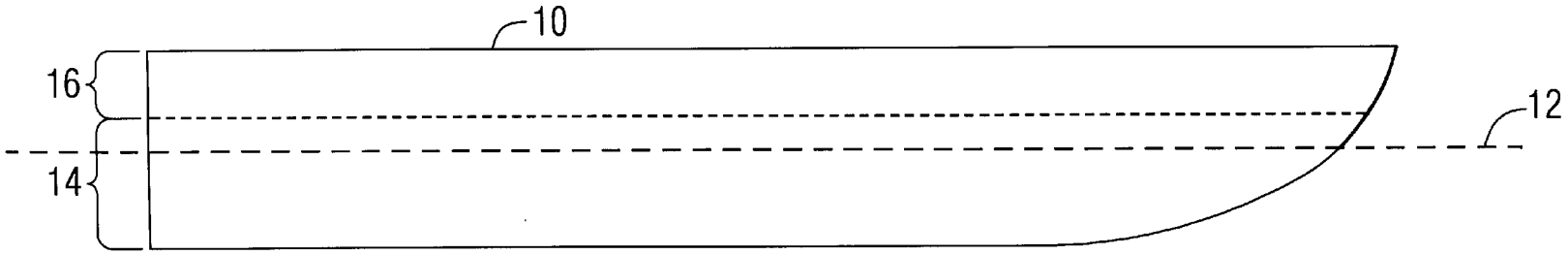
FIGS. 1 and 2 show two views of a boat hull.

Throughout the description of the preferred embodiment of the present invention, like components will be identified by like reference numerals.

The invention described in U.S. Pat. No. application Ser. No. 09/188,967 (M09308) recognizes that chlorine bubbles attached to an underwater surface inhibit the growth of marine organisms, such as barnacles. It also recognizes that current flowing from an underwater surface causes chlorine bubbles to be formed on the surface. In other words electrical power, can be used to produce chlorine gas which can attach to the submerged surface in the form of very small bubbles of chlorine gas.

Many experiments have been performed to determine a more efficient way to produce chlorine gas directly on a surface in this way through the use of electrical power. It is important to produce the chlorine gas in a way that maximizes efficiency while maintaining the effectiveness of the gas. The present invention described below takes advantage of the lessons learned during this experimentation and provides a system that produces maximum results in the inhibition of marine fouling while minimizing the magnitude of electrical power required to perform this task.

FIG. 1 shows a side view of a boat 10 floating in a body of water having a surface 12. The portion of the hull identified by reference numeral 14 represents the portion of the hull that is subject to marine fouling. Above that portion, an upper region 16 typically does not experience sufficient wetting to be fouled by marine organisms, such as barnacles.

Figure 2:
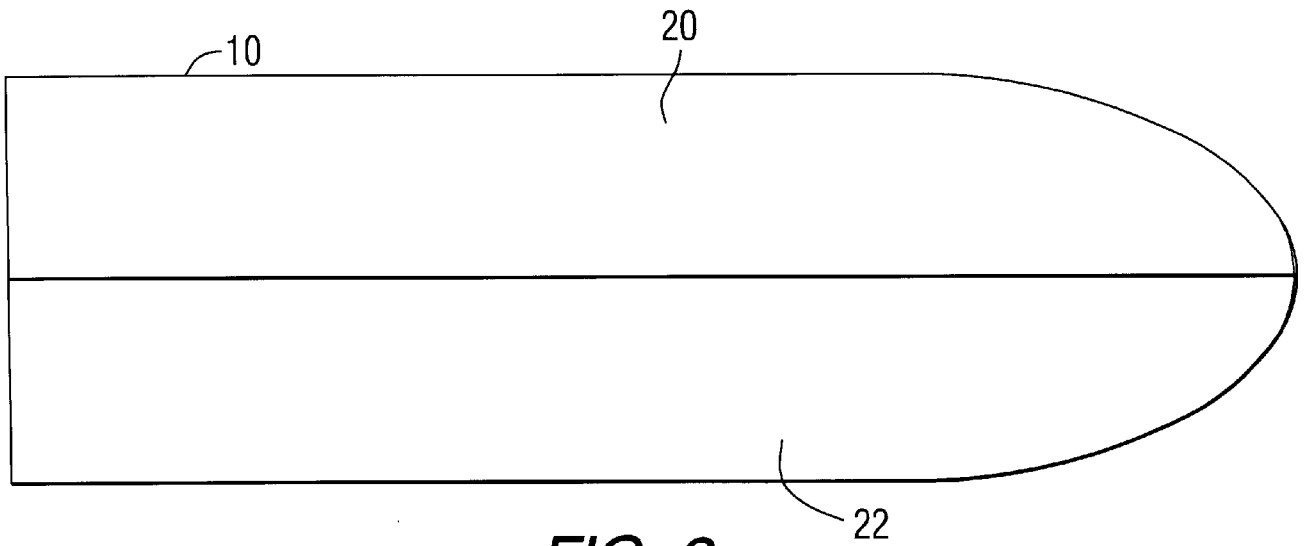

While FIG. 1 shows the starboard side of the boat 10, FIG. 2 shows an underside view of the boat 10 with both the starboard portion 20 and the port portion 22. The wetted region 14 of the hull surface is susceptible to marine fouling on both the starboard and port sides of the boat 10.

Figure 3:
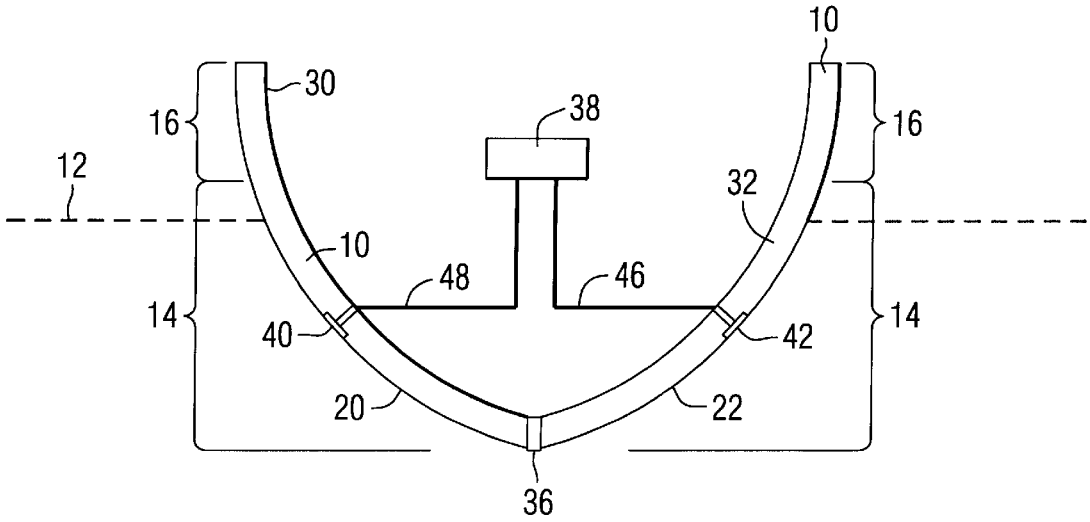
FIG. 3 shows a sectional view of a boat hull.

FIG. 3 shows a section view taken through the boat 10, showing the starboard portion 20 of the hull and the port portion 22 of the hull. These surfaces are the wetted surfaces of the starboard side 30 and the port side 32 of the boat. Both the starboard 20 and the port 22 surfaces are electrically conductive and are separated from each other by an insulative member 36 to prevent direct contact between the starboard and port conductive surfaces, 20 and 22. A current source 38 is provided and connected in electrical communication with both the starboard and port electrically conductive surfaces. Electrode 40 connects the power source 38 with the starboard surface 20 and electrode 42 connects the power source 38 with the port conductive surface 22. Although not shown in detail, it should be understood that the power source 38 is an electric current source that typically comprises a battery or a shore power connection, a control circuit and certain monitoring circuits in a preferred embodiment of the present invention. Current is caused to flow from the power source 38 to electrode 42, through conductor 46, and the circuit is completed through the water in which the boat 10 is operated. The water allows the circuit to be completed from electrode 42 to electrode 40 and then, through conductor 48, to the power source 38. The two electrodes, 40 and 42, are connected in electrical communication with their respective electrically conductive surfaces, 20 and 22.

When electricity is passed through an electrolyte, such as sea water, a chemical reaction called electrolysis occurs. The flow of electricity through the sea water causes those chemical changes to occur. As an example, since sea water contains various salts, such as sodium chloride for example, an oxidation action occurs at the anode as electrons are lost from neutrally charged species creating cations. Chlorine gas is formed at the anode as a result of two chloride ions losing electrons and combining with each other. As a result of the electrolysis described above, the sodium chloride molecule is split into elemental sodium and chlorine. When a voltage is placed across two conductive surfaces immersed in an electrolyte, electrons are driven from the anode to the cathode by an external circuit to create a charged cathode that attracts positively charged ions. The negatively charged chlorine ions can give up their electrons to the anode to form gaseous chlorine. As a result, sodium collects at the cathode while chlorine gas collects on the anode. Since sea water contains many different salts, calcium also typically collects on the surface of the cathode.

Naturally, if the electrical current from the power source perpetually flowed in one direction, the anode would be adequately protected by the chlorine gas collecting on its conductive surface, but the cathode would not be protected in this way from marine fouling. Also, the cathode would quickly become coated with the various elements formed from positive ions receiving an electron from the cathode. By periodically reversing the direction of current, the present invention allows both conductive surfaces to periodically act as the anode and alternately to periodically act as the cathode. This provides the creation of chlorine gas bubbles on both surfaces, in an alternating manner, which is sufficient to discourage marine growth. This periodic switching of the direction of current also prevents the excessive buildup of elemental sodium and calcium on the anode.

Figure 4:
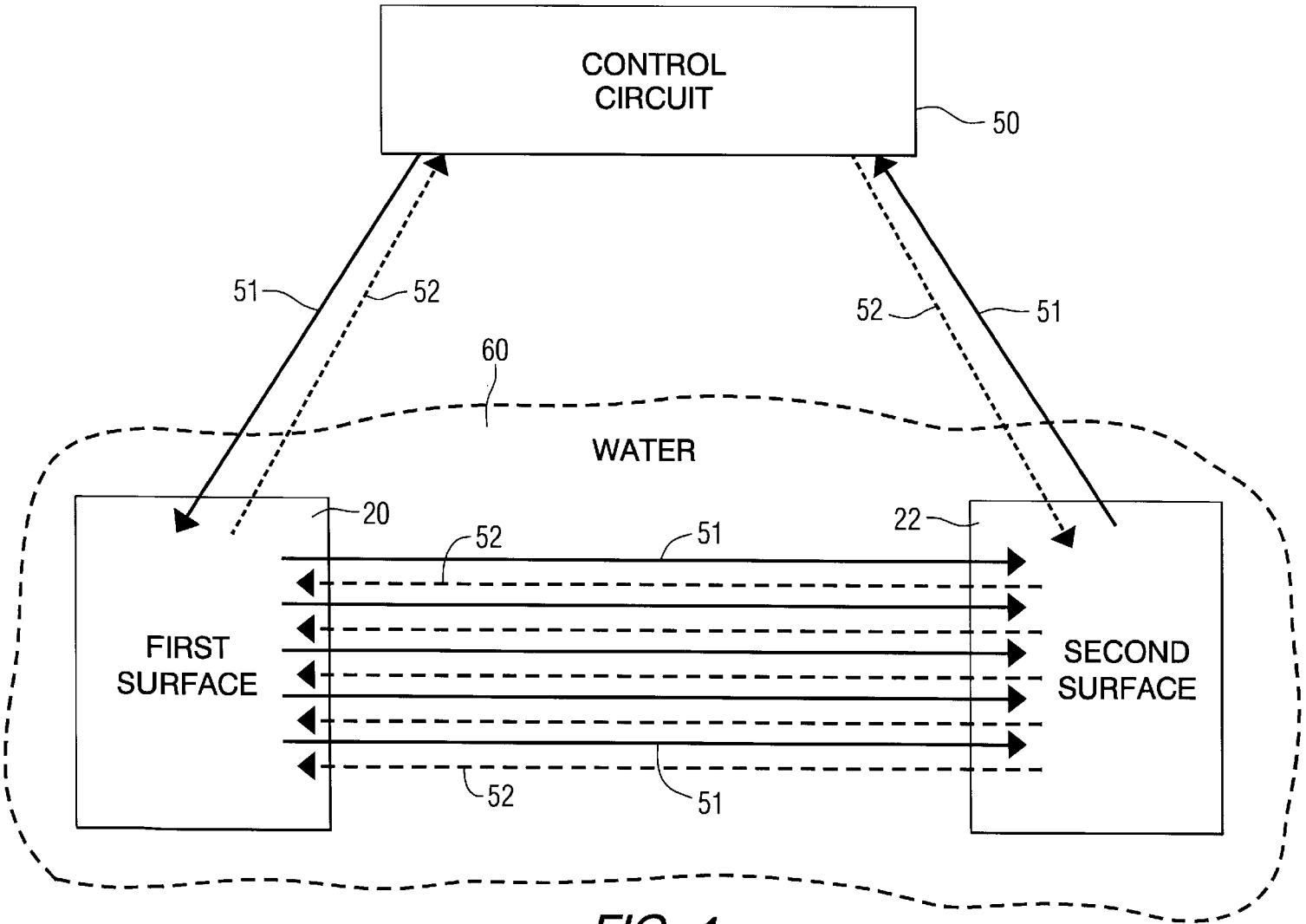
FIG. 4 is a schematic representation illustrating the operation of the present invention.

FIG. 4 is a highly schematic representation of the first and second surfaces, 20 and 22 described above in conjunction with FIGS. 2 and 3. The power source is provided with a control circuit 50 that is capable of selecting a direction of travel for the current emanating from the power source, such as a battery or shore power. Two alternative directions of current flow are illustrated in FIG. 4 by the solid line arrows 51 and the dashed line arrows 52. Both alternative current directions pass through the power source, the first surface 20, the second surface 22 and the water 60 surrounding the wetted surfaces of the boat. In a preferred embodiment of the present invention, the direction of current is alternated at predetermined time period intervals in order to maximize the efficiency of the system in both its effectiveness in inhibiting marine fouling and its efficient use of electrical power for these purposes.

Figure 5:
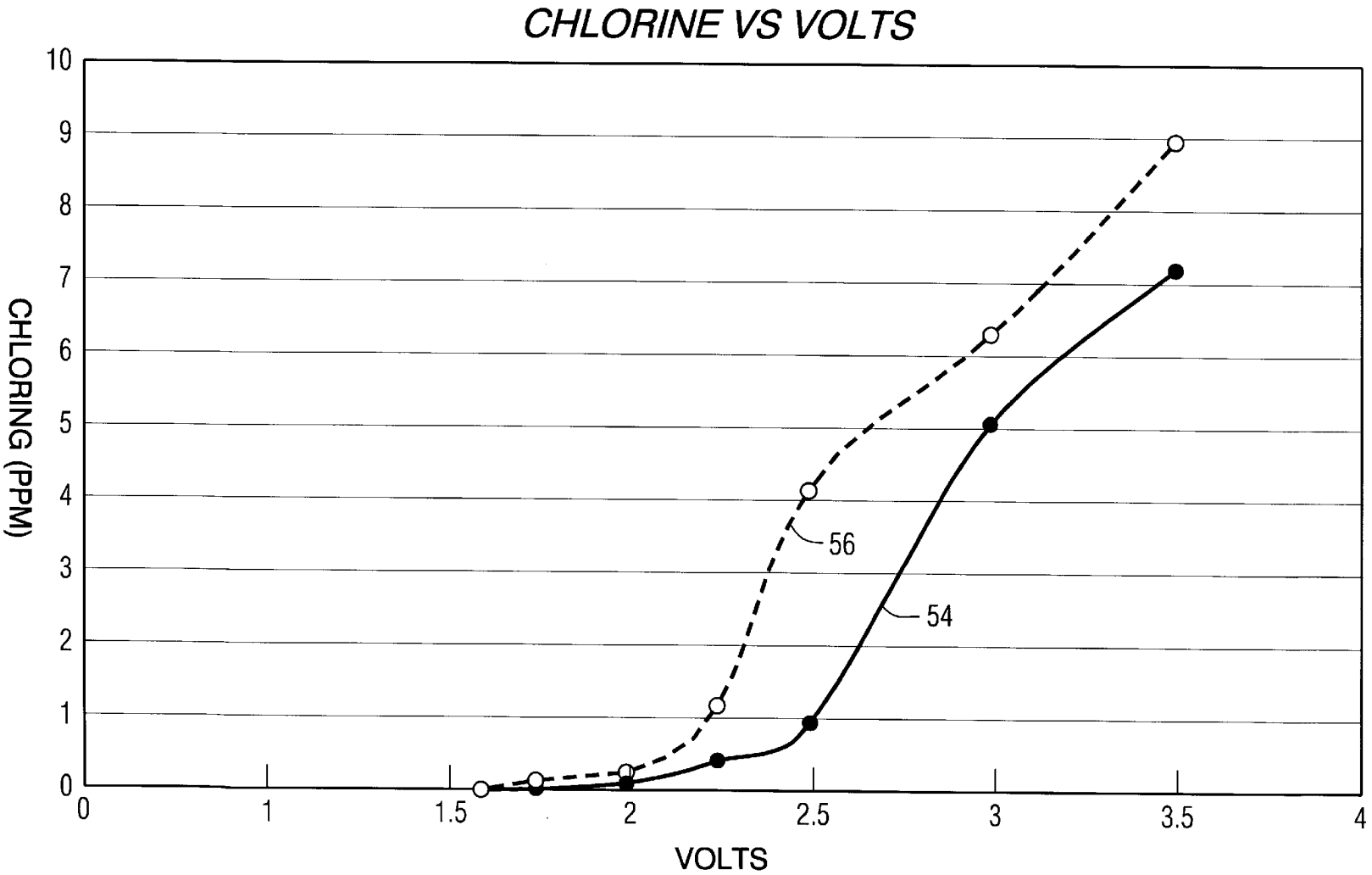
FIG. 5 shows the production of chlorine as a function of voltage.

FIG. 5 is a graphical representation of the chlorine production from the surfaces of two graphite rods that were used to empirically determine the effect of various voltage potentials, current flows, and power consumption in the production of chlorine. The solid line 54 in FIG. 5 represents the chlorine production of a single graphite rod at various voltage potentials. The single rod was connected to the identified voltage potential for a fixed period of time and the chlorine produced during this experiment was then measured manually. The dashed line 56 represents the same experiment, but with two graphite rods. The two graphite rods produced more chlorine because the total surface area was twice as much as with a single graphite rod 54. With reference to FIG. 5, it is important to notice that little or no chlorine was produced until a threshold of approximately 2 volts was exceeded. In other words, voltages lowered than 2 volts produced little or no chlorine regardless of the time period allowed. After exceeding the minimum threshold potential of approximately 2 volts, chlorine was produced in a measurable quantity.

Figure 6:
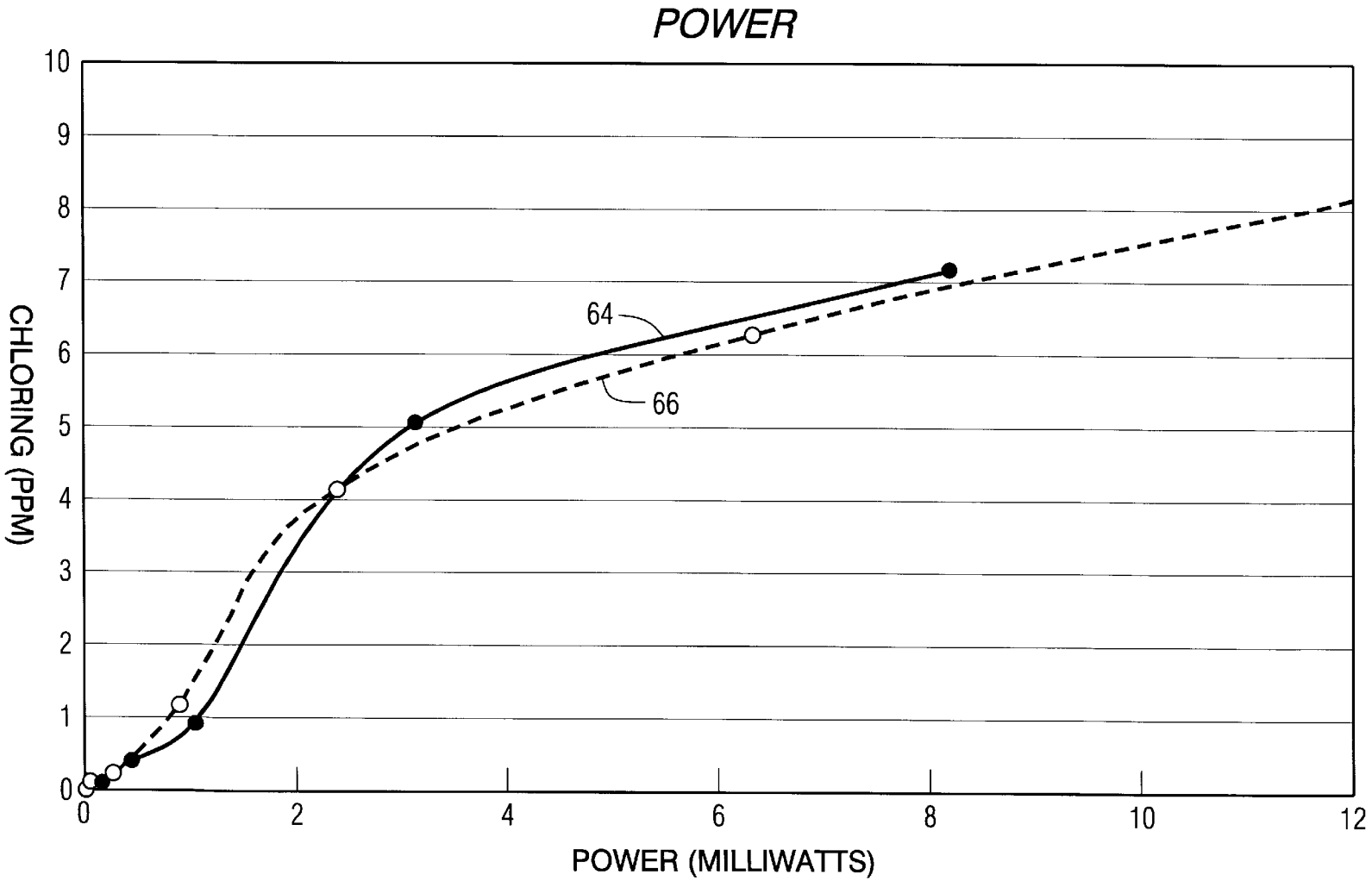
FIG. 6 shows the production of chlorine as a function of power.

FIG. 6 shows the chlorine production, for a single rod 64 and for two rods 66, as a function of power consumption. As can be seen, chlorine production is a non-linear function of power consumption, but not directly affected by the surface area through which the current flows into the surrounding water.

With reference to FIGS. 5 and 6, it can be seen that chlorine production is a function of power consumption when electric current flows from the conductive surfaces at voltage levels above a minimum threshold of approximately 1.5 to 2.0 volts. It can therefore be stated that chlorine gas can be created by causing an electrical current to flow from an electrically conducted surface into a surrounding body of water. However, it is important that the precise dynamics of this chlorine gas production be evaluated carefully to determine how best to provide the electrical current from the electrically conductive surface or surfaces.

Figure 7:
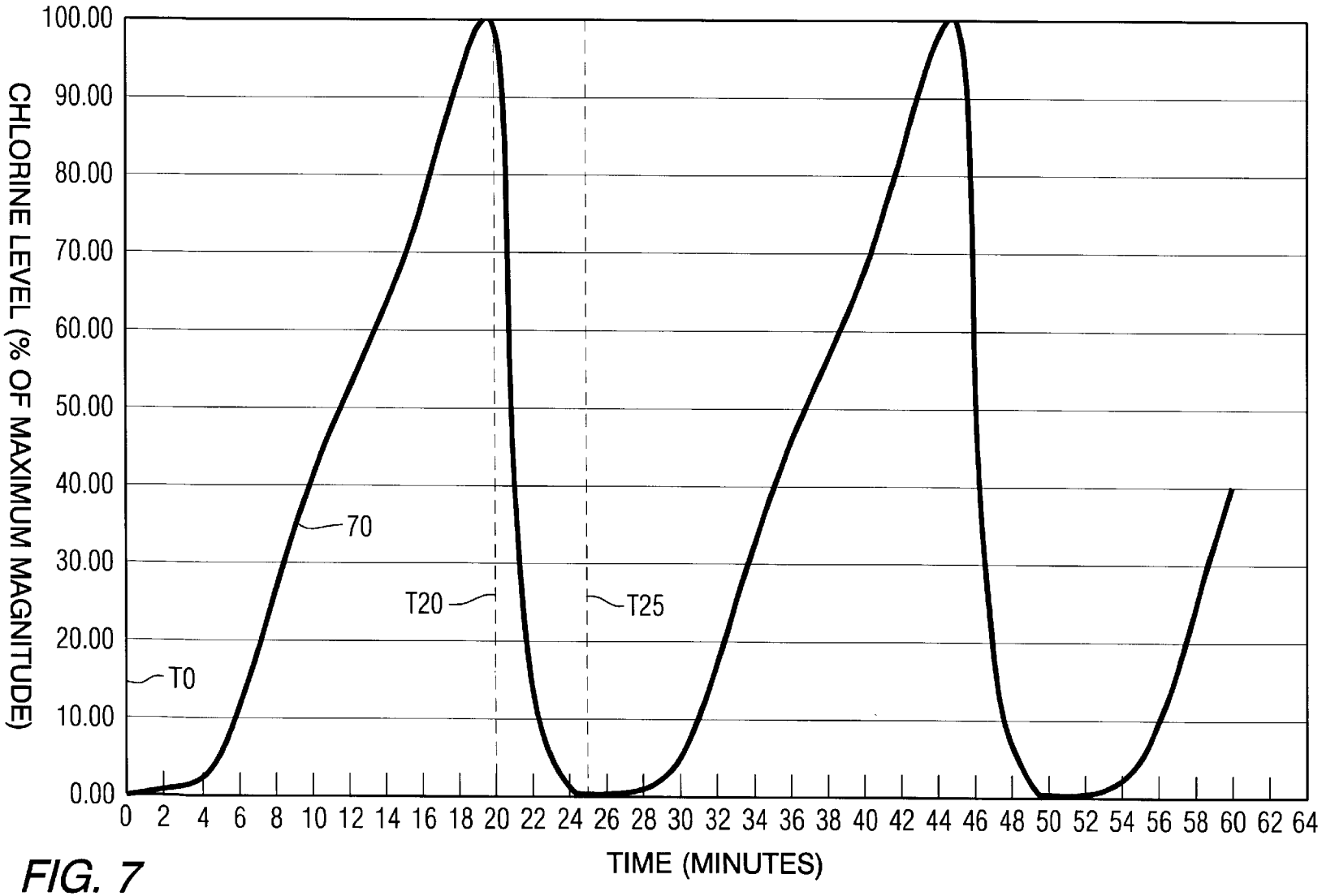
FIG. 7 shows a time based graph of chlorine production.

FIG. 7 is a time based graphical representation of the production of chlorine bubbles on an electrically conductive surface. It is important to realize that although chlorine gas is continually produced as current flows from a submerged surface, the chlorine gas dissipates rather quickly when the current stops flowing from the surface. It is also necessary to realize that the rate of chlorine gas production is a function of dissipated electric power and the time during which the current flows from the submerged surface. In the graphical representation of FIG. 7, curve 70 shows the amount of chlorine gas at a submerged surface, represented as a percentage of the maximum gas quantity achieved. It should be understood that the line 70 is an amalgam of several actual tests, but has been synthesized for the purpose of showing the behavior of the marine fouling protection system over time. Between time T0 and twenty minutes T20 the quantity of chlorine continually increases from 0% to 100%. This production of chlorine resulting from a test that imposed a voltage of 4.2 volts and produced a current of 5.3 milliamperes. When the voltage was turned off, at 20 minutes T20, the chlorine gas on the submerged surface immediately began to dissipate into the surrounding water. Within approximately five minutes, virtually all of the chlorine gas had disappeared from the submerged surface. As shown by curve 70, if the power was again provided at the time of 25 minutes at T25, the chlorine again began to form on the submerged surface.

It has been empirically determined that marine organisms, such as barnacles, exhibit a tolerance for certain minimal levels of chlorine gas on a submerged surface. Above that tolerable level, marine organisms are killed, or at least effectively discouraged from attaching to the submerged surface. As a result, if the quantity of chlorine gas adhering to a submerged surface is less than the tolerable level, even though some chlorine gas is present, marine organisms can attach to the surface and grow. However, above that tolerable level, marine organisms will not attach to the submerged surface and, if they have already attached prior to the presence of a chlorine gas, the marine organisms will die or detach from the surface. As a result, it can be seen that it is not necessary for the submerged surface to be continually coated with chlorine gas bubbles. It is sufficient to provide chlorine gas on the submerged surface at periodic intervals as long as the quantity of chlorine gas during those periodic intervals is sufficient to exceed the tolerable levels of the marine organisms even if the toxic level of chlorine is not always present.

Figure 8:
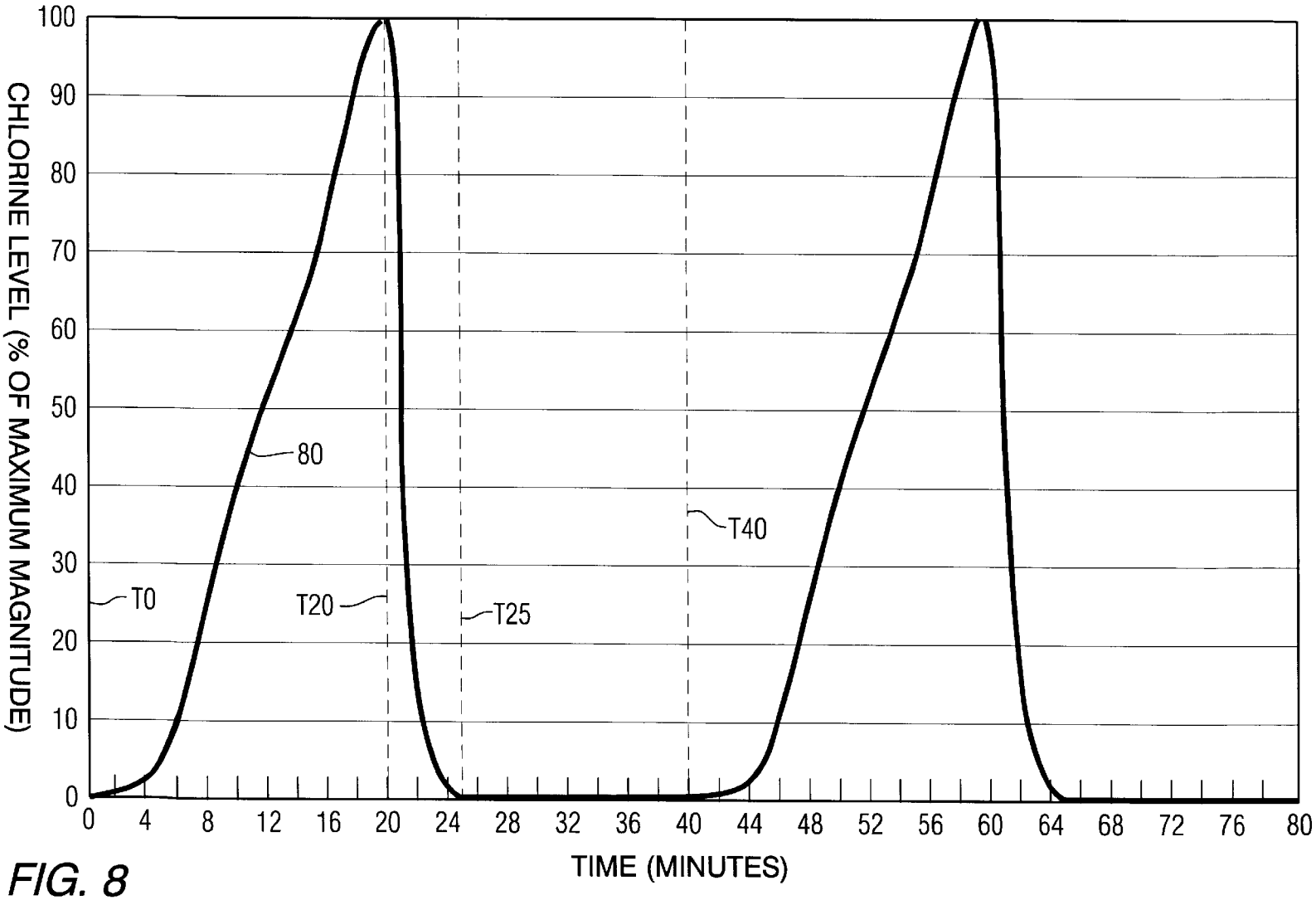
FIG. 8 shows a hypothetical time based graph of chlorine production.

It has been determined that the rate of production of chlorine gas on the submerged surface is a function of both current density and duration. For example, a high current density in excess of 10 milliamperes per square foot can produce acceptable levels of chlorine gas in very short time periods such as 60 seconds. Alternatively, a much lower current density can produce adequate quantities of chlorine gas on the submerged surface if sufficient time is allowed. For example, it has been determined that current densities as low as 0.50 milliamperes per square foot are sufficient to provide enough chlorine gas if the current is continued for a period of approximately 20 minutes. Lower currents, such as 0.10 milliamperes per square foot may also be effective in certain applications. As discussed above, the chlorine gas begins to dissipate immediately when the current is turned off. Considering all of these characteristics of the marine organisms and chlorine production on a submerged surface, it has been determined that significant advantages can be achieved if low current densities are used for longer time periods and the current direction is alternated between two submerged surfaces. As an example, current can be caused to flow from a first submerged surface to a second submerged surface for a period of 20 minutes at a current density of approximately 0.50 milliamperes per square foot. Then the current can be reversed for a subsequent period of 20 minutes. This process would continue indefinitely or until terminated by a control circuit. It is believed that the time during which chlorine is present in intolerable quantities on the first surface will be sufficient to prevent marine growth on that surface even though the quantity of chlorine will dissipate and then be virtually absent from that first surface during the period of time when current is flowing from a second surface and into the first surface. FIG. 8 shows this hypothetical chronology.

In FIG. 8, line 80 represents the pattern of chlorine level on a first surface during a period of approximately 80 minutes. During the first 20 minutes, electrical current is caused to flow from the first surface, through the sea water, and into a second surface. Chlorine gas continually accumulates on the surface until it reaches the 100% level at 20 minutes T20. Then, between T20 and T40, the process is reversed and current is caused to flow from a second surface into the first surface. During this time period, the chlorine gas rapidly dissipates. From time T20 to time T25, virtually all of the chlorine eventually disappears from the first surface. After the chlorine gas is dissipated, at time T25, the first surface remains virtually chlorine free until time T40. During the time between T20 and T40, the chlorine level on the second surface is being increased in a similar manner. However, during this period between time T20 and time T40 the quantity of chlorine gas on the first surface is very low. However, it has been theorized that marine organisms will not have sufficient time to attach themselves to the first surface during the 20 minute period between T20 and T40. Even if some marine organisms begin to attach themselves to the first surface, chlorine gas bubbles will begin to form quickly after the current is again reversed to cause current to flow from the first surface again, beginning at time T40. Within the next twenty minutes, the chlorine level will again be increased to 100% and this chlorine gas quantity is sufficient to discourage marine organism growth from remaining on the first surface.

The use of extended time periods, such as twenty minutes or more, allows the marine fouling prevention system to use very small current densities. This has the significant benefit of extending battery life. It has been experimentally determined that chlorine gas can be created in sufficient quantities at low current densities, such as 0.50 milliamperes per square foot, as long as the minimum threshold voltage of approximately 1.5 millivolts to 2.0 millivolts is provided. As a result of these experiments, it was determined that the use of two submerged surfaces of generally equal area can be used, in an alternating manner, to provide current from one of the surfaces to the other surface.

Figure 9:
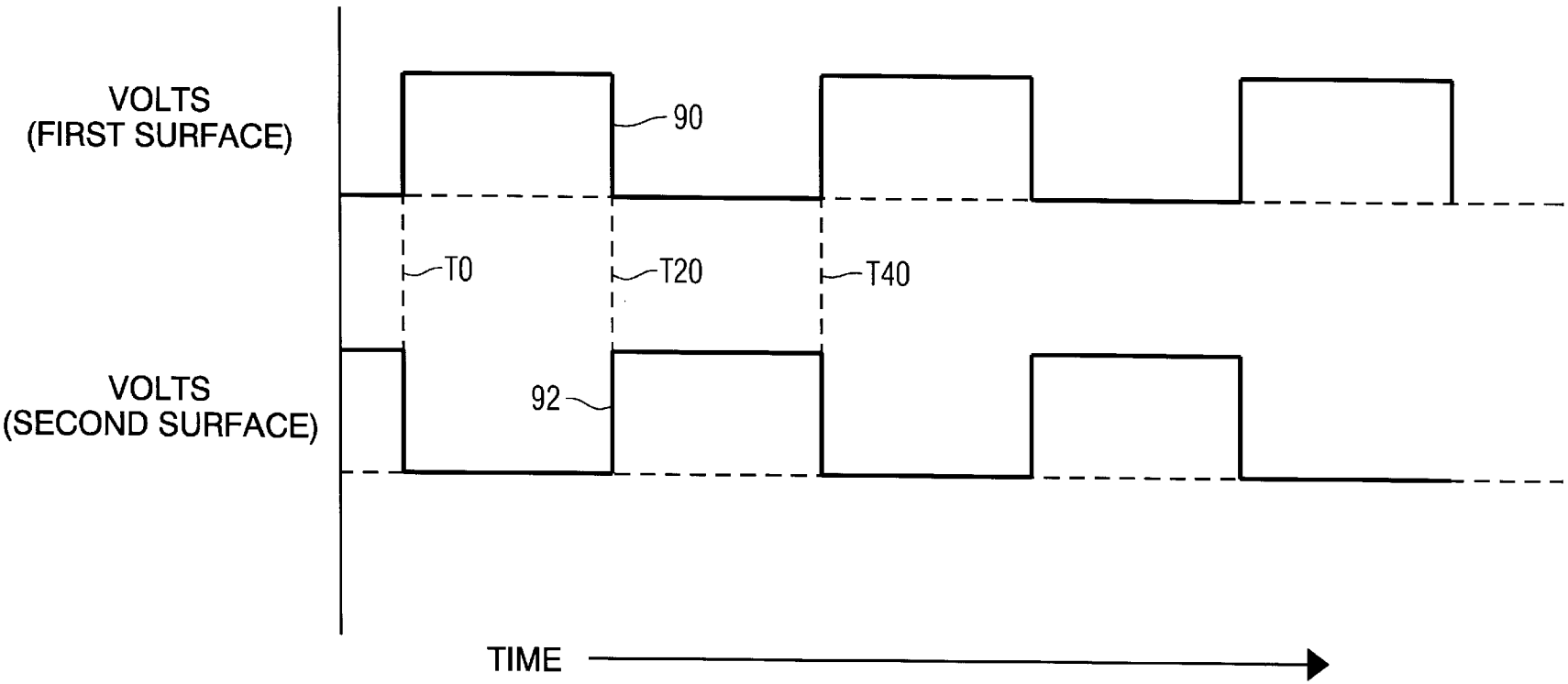
FIG. 9 shows a time based voltage pattern for first and second surfaces.

FIG. 9 shows a time based graphical representation of the voltages at the first and second surfaces. As can be seen, the first surface is provided with a voltage potential for approximately 20 minutes from time T0 to time T20. Then, the process is reversed and the voltage is provided to the second surface while the first surface is connected to a point of ground potential. The alternating voltage patterns illustrated in FIG. 9 cause the current to flow back and forth between the first and second surfaces. It should be understood that the dashed lines identified as T0, T20, and T40 are used for comparison between FIGS. 8 and 9.

Figure 10:
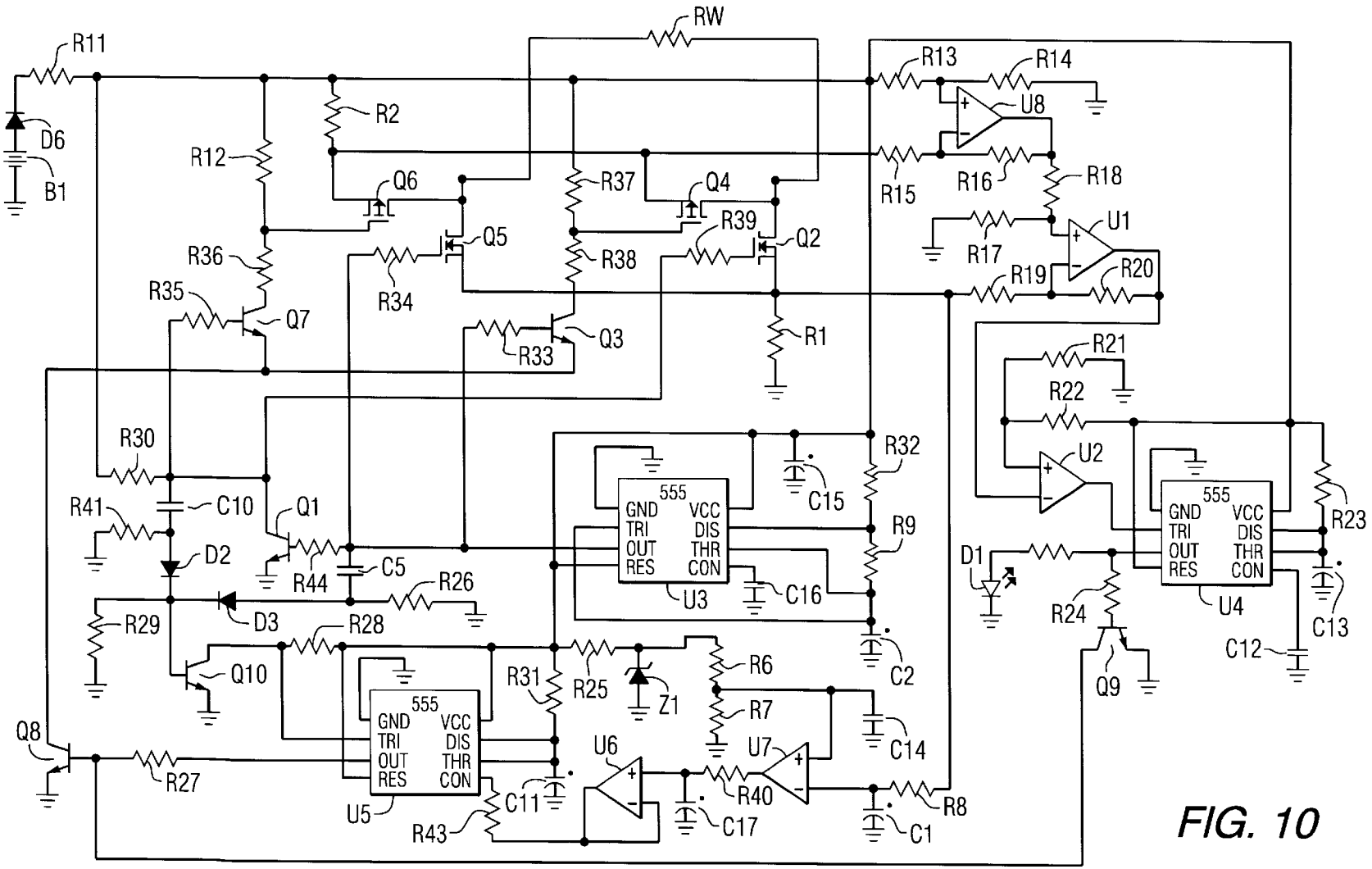
FIG. 10 shows an electric circuit for implementing the present invention.

FIG. 10 is a schematic representation of an electrical circuit that has been developed for the purpose of implementing the features of the marine fouling prevention system described above. The components are identified in Table I. The square wave oscillator U2 provides an output to the base of transistor Q1 which, in turn, turns off field effect transistor (FET) Q2. Simultaneously, this same output from U3 is also connected to the base of transistor Q3 which is turned on and connects transistor Q2 to ground. As a result, the output from U3 turns transistor Q4 on and turns transistor Q2 off. The output from the square wave oscillator U3 is also connected to the base of transistor Q5. As a result, transistors Q1, Q4, and Q5 are turned on as a result of a high output from U3 which turns transistor Q2 off. Q6 is turned off by the high output from U3 because Q7 is turned off as a result of transistor Q1 being on. This turns transistor Q6 off.

In summary, a high output from the square wave oscillator U3 results in transistor Q6 being turned off, transistor Q5 being turned on, transistor Q4 being turned on, and transistor Q2 being turned off. As a result, current can only flow from right to left through the resistance RW of the sea water. Transistor Q4 is connected to the first conductive surface and transistor Q5 is connected to the second conductive surface. Resistor RW in FIG. 10 represents the resistance of the sea water surrounding the submerged surfaces. The current flowing through the sea water RW and into the second surface, which is connected to transistor Q5, is caused to flow to ground potential through a sense resistor R1. Differential comparitor U1 compares the current flowing through the sense resistor R1 to the current flowing through another sense resistor R2. If these two currents are not equal to each other, within an allowable tolerance differential, an alarm condition is detected. The purpose of comparitor U2 is to make sure that no leakage current is flowing to a component other than the intended submerged surfaces. Leakage currents of this kind can cause extensive corrosive damage to various components of the boat and its propulsion system. The gain of U1 is used to set the acceptable tolerance level for the difference between the currents flowing through resistors R1 and R2. A fault condition results in oscillator U4 being turned on which, in turn, provides an output to a light emitting diode D1 to signal an alarm condition to the operator.

With continued reference to FIG. 10, oscillator U5 provides an output to transistor Q8 which is a current sink for transistors Q7 and Q3. When a fault occurs, transistor Q9 is turned off and this, in turn, turns transistor Q8 on. When transistor Q8 is turned off, transistors Q6, Q5, Q2 and Q4 are prevented from operating. These four transistors form a current switching network that is turned off when transistor Q8 is turned off as a result of a fault condition. They also allow the current to be switched from one direction to the other direction through the sea water RW between the first and second conductive surfaces.

The square wave oscillator U3 determines the time period used to conduct current in one direction and also determines the time when the current should be switched to the opposite direction. Component U5 is a current limiter. The current flowing through sense resistor R1 is also connected to a current limiter U5 through an integrator that comprises operational amplifiers U6 and U7.

Operational amplifier U7 operates as an comparitor that compares the current through resistor R1 to a preselected magnitude determined by Zenner diode Z1 and resistors R6 and R7. In the event that the current flowing through sense resistor R1 exceeds the preselected threshold, the current limiter U5 terminates the current flow until capacitor C1 discharges sufficiently to allow the current to be resumed in the preselected direction. This current limiting function protects the material of the first and second conductive surfaces. Excessive current densitites could damage the conductive coatings. The time period, such as twenty minutes through which current flows in one direction, is determined by the time constant provided by resistor R9 and capacitor C2.

When the oscillator U3 senses a timeout of the preselected time period, such as twenty minutes, which is determined by resistor R9 and C2, it's output goes low and turns transistor Q1 off. This turns transistor Q2 on and simultaneously turns transistor Q3 off. Also, transistor Q5 is turned off and transistor Q4, as a result of resistor Q3 being off, is turned off. Transistor Q7 is turned on as a result of the low output from U3 and, as a result, transistor Q6 is turned on. The same sense resistors, R1 and R2, are used to monitor the current magnitude when the current is flowing in the opposite direction from left to right through the sea water RW.

Differential amplifiers U1 and U8 compare the currents flowing through resistors R1 and R2 to assure that these currents are generally equal to each other. This assures that no leakage current is flowing to any component.

A positive output from U3 through capacitor C 5, turns transistor Q10 on. This triggers the monostable oscillator U5. Diodes D2 and D3 allow a positive pulse in either direction to turn transistor Q10 on. Therefore, any change in state of the output of the square wave oscillator U3 will cause U5 to initiate a new sequence. The current limiter U5 can be set for any time period less than or equal to the time period determined by the square wave oscillator U3. In other words, during a twenty minute interval determined by U3, current can optionally be limited to a time period less than twenty minutes.

With continued reference to FIG. 10, it should be understood that the circuit not only switches the direction of current back and forth between the first and second conductive surfaces but, more significantly, that the circuit monitors the current flowing out of one conductive surface and compares it to the current flowing into the other conductive surface to make sure that a fault condition occur.

TABLE I

| REF | TYPE or VALUE |
|---|---|
| R1 | .01 ohms |
| R2 | .01 ohms |
| R6 | 10k Ω |
| R7 | 200 Ω |
| R8 | 100k Ω |
| R9 | 100k Ω |
| R11 | 0.18 Ω |
| R12 | 10k Ω |
| R13 | 100k Ω |
| R14 | 100k Ω |
| R15 | 100k Ω |
| R16 | 100k Ω |
| R17 | 100k Ω |
| R18 | 100k Ω |
| R19 | 100k Ω |
| R20 | 100k Ω |
| R21 | 1k Ω |
| R22 | 100k Ω |
| R23 | 1M Ω |
| R24 | 10k Ω |
| R25 | 1k Ω |
| R26 | 10k Ω |
| R27 | 10k Ω |
| R28 | 10k Ω |
| R29 | 10k Ω |
| R30 | 1k Ω |
| R31 | 10k Ω |
| R32 | 1k Ω |

TABLE I-continued

| REF | TYPE or VALUE |
|---|---|
| R33 | 10k Ω |
| R34 | 1k Ω |
| R35 | 10k Ω |
| R36 | 1k Ω |
| R37 | 10k Ω |
| R38 | 10k Ω |
| R39 | 1k Ω |
| R40 | 100k Ω |
| R41 | 10k Ω |
| R43 | 1k Ω |
| R44 | 10k Ω |
| Q1 | Inverter |
| Q2 | MTP36N06E |
| Q3 | Control |
| Q4 | MTP30P06V |
| Q5 | MTP36N06E |
| Q6 | MTP30P06V |
| Q7 | Control |
| Q10 | Trigger |
| D1 | Fault alarm |
| U1 | Current comparitor |
| U2 | Current fault |
| U3 | Square wave oscillator |
| U4 | Monostable oscillator |
| U5 | Monostable oscillator |
| U7 | Current regulator |
| C1 | 1 Microfarad |
| C2 | 1 Microfarad |
| C5 | 0.01 Microfarad |
| C10 | 0.01 Microfarad |
| C11 | 1 Microfarad |
| C12 | 0.01 Microfarad |
| C13 | 1 Microfarad |
| C14 | 0.01 Microfarad |
| C15 | 1 Microfarad |
| C16 | 0.01 Microfarad |
| C17 | 1 Microfarad |
| Z1 | 1N5231 (5.1 volts) |

Figure 11:
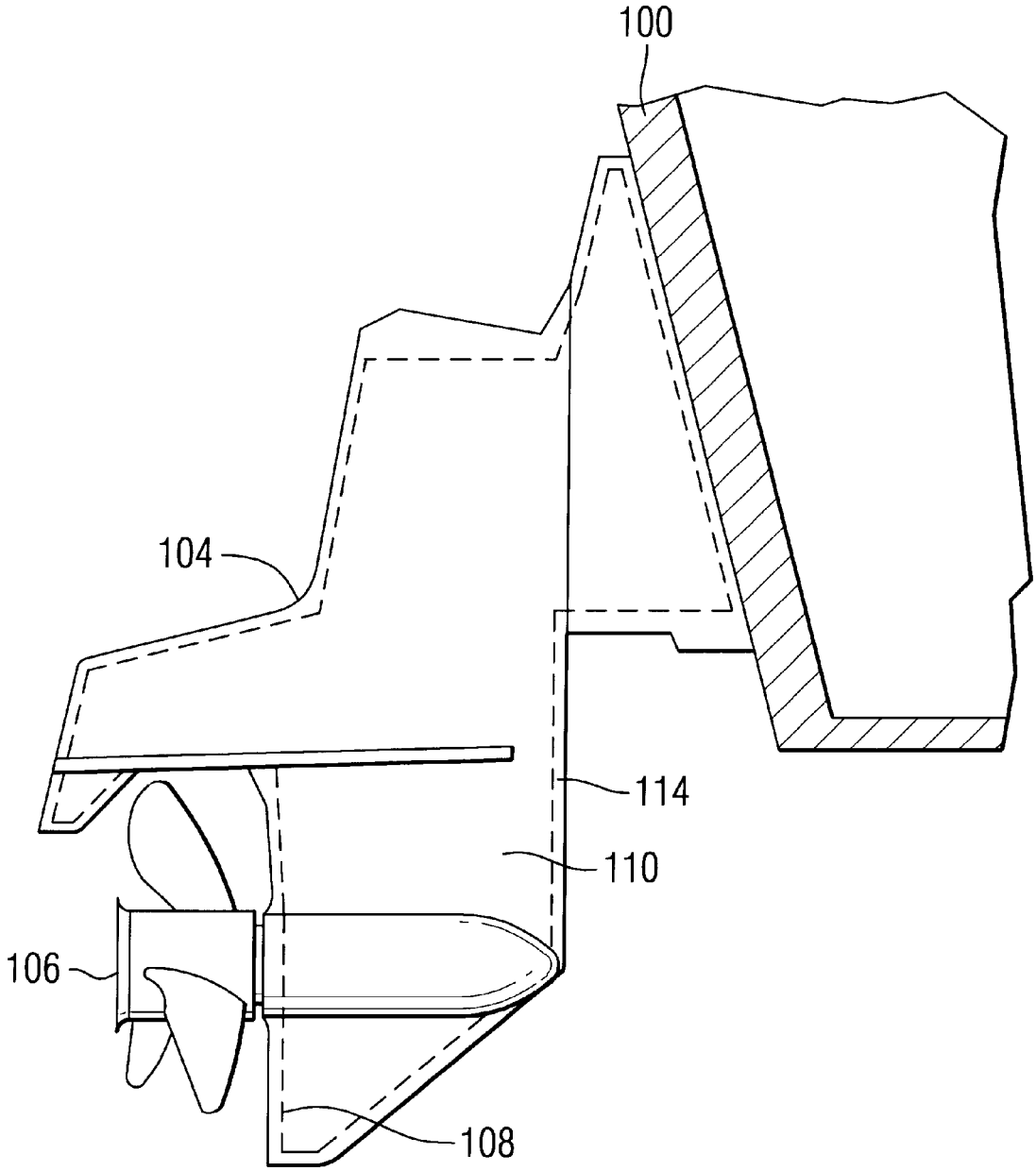
FIG. 11 shows an embodiment of the present invention in conjunction with a stem drive unit.

The present invention has been described above in relation to two conductive surfaces on a hull of a boat. However, it should be clearly understood that it can also be applied to many other devices. FIG. 11 shows a stem drive unit attached to a boat. Extending rearward from the transom 100 of a boat, the stem drive unit comprises a housing 104 within which a plurality of components, such as shafts, bearings, and gears, are contained. The external surface of the stem drive unit is susceptible to marine growth and fouling. A propeller 106 is attached to a propeller shaft within the housing 104.

Dashed line 108 represents a region on the external surface of the housing 104. This external region can be painted with a conductive material, such as a graphite paint, to provide the first or second conductive surface. On the opposite side (i.e. the port side) of the stern drive unit, a similarly shaped region would also be painted with an electrically conductive paint. That region would operate as the other conductive surface. As can be seen, the conductive surface 110 between the dashed lines 108 does not completely cover the entire outer surface of the housing 104. A non conducting region 114 separates the conductive portion 110 from the other conductive portion on the port side of the stem drive unit. The two conductive portions of the external surface of the housing 104 are not connected directly to each other electrically. Instead, they are both connected to a control circuit (not shown in FIG. 11) which controls the magnitude and direction of current flowing to and from the two conductive surfaces. When in operation, current would flow from one side of the stem drive unit to the other side, between the two conductive surfaces. Sea water surrounding the stern drive unit would provide the completed electrical circuit between the two conductive surfaces. As a result, marine fouling can be prevented on the outer surface of the housing 104.

It should be understood that the present invention is capable of preventing marine fouling on other types of conductive surfaces besides boat hulls and housings of stem drive units. It is suitable for use with underwater components such as metal pilings, conductive drain covers, grates, housings, covers, access doors, conduits, drain pipes, support structures, drilling platforms, and other applications. As long as the two conductive surfaces are isolated from each other to prevent direct current flow between them and the current is caused to flow from one of the surfaces to the other through the surrounding sea water, chlorine production can be assured.

I claim:

1. A marine fouling prevention system, comprising:

a first electrically conductive surface disposed at least partially below the surface of a body of water during operation of said fouling prevention system;

a second electrically conductive surface disposed at least partially below the surface of said body of water during operation of said fouling prevention system;

an electric current generating device connected in electrical communication with said first electrically conductive surface and said second electrically conductive surface to cause an electric current to flow between said first and second electrically conductive surfaces;

a control circuit connected in electrical communication with said first and second electrically conductive surfaces to periodically change the direction of said electrical current between said first and second electrically conductive surfaces;

a timer for causing said control circuit to cause said direction of current to change after a preselected period of time in one of two possible directions; and a fault detection circuit which compares said current flowing from one of said first and second electrically conductive surfaces with said current flowing into the other one of said first and second electrically conductive surfaces.

2. The system of claim 1, wherein:

said first electrically conductive surface is first portion of a boat hull and said second electrically conductive surface is a second portion of said boat hull.

3. The system of claim 1, wherein:

said first electrically conductive surface is first portion of the surface of a stem drive unit and said second electrically conductive surface is a second portion of said stern drive unit.

4. The system of claim 1, wherein:

said first and second surfaces comprise an inert metallic conductor.

5. The system of claim 1, wherein:

said first and second surfaces comprise a graphite material.

6. The system of claim 5, wherein:

said graphite material is embedded within a nonconductive matrix.

7. The system of claim 1, wherein:

said first and second surfaces comprise a metallic oxide.

8. The system of claim 1, wherein:

said current flowing between said first and second electrically conductive surfaces has a current density less than fifty milliamperes per square foot.

9. The system of claim 8, wherein:

said current flowing between said first and second electrically conductive surfaces has a current density less than twenty milliamperes per square foot.

10. The system of claim 1, wherein:

said predetermined period of time is greater than five minutes.

11. The system of claim 10, wherein:

said predetermined period of time is greater than ten minutes.

12. The system of claim 11, wherein:

said predetermined period of time is greater than twenty minutes.

13. The system of claim 1, further comprising:

an alarm circuit which detects an alarm condition when said current flowing from said one of said first and second electrically conductive surfaces does not equal said current flowing into the other one of said first and second electrically conductive surfaces within an acceptable differential magnitude.

14. A method for preventing marine fouling, comprising:

providing a first electrically conductive surface disposed at least partially below the surface of a body of water during operation of said fouling prevention system;

providing a second electrically conductive surface disposed at least partially below the surface of said body of water during operation of said fouling prevention system;

causing an electric current to flow between said first and second electrically conductive surfaces;

periodically changing the direction of said electrical current between said first and second electrically conductive surfaces;

causing said direction of current to change after a preselected period of time in one of two possible directions; and comparing said current flowing from one of said first and second electrically conductive surfaces with said current flowing into the other one of said first and second electrically conductive surfaces.

15. The method of claim 14, further comprising:

detecting an alarm condition when said current flowing from said one of said first and second electrically conductive surfaces does not equal said current flowing into the other one of said first and second electrically conductive surfaces within an acceptable differential magnitude.

16. Apparatus for preventing marine fouling, comprising:

means for providing a first electrically conductive surface disposed at least partially below the surface of a body of water during operation of said fouling prevention system;

means for providing a second electrically conductive surface disposed at least partially below the surface of said body of water during operation of said fouling prevention system;

means for causing an electric current to flow between said first and second electrically conductive surfaces;

means for periodically changing the direction of said electrical current between said first and second electrically conductive surfaces;

means for causing said direction of current to change after a preselected period of time in one of two possible directions; and means for comparing said current flowing from one of said first and second electrically conductive surfaces with said current flowing into the other one of said first and second electrically conductive surfaces.

17. The method of claim 16, further comprising:

means for detecting an alarm condition when said current flowing from said one of said first and second electrically conductive surfaces does not equal said current flowing into the other one of said first and second electrically conductive surfaces within an acceptable differential magnitude.

* * * * *